United States Patent [19]

Kress

[11] Patent Number: 4,623,271

[45] Date of Patent: Nov. 18, 1986

[54] INK RIBBON CARTRIDGE FOR A PRINTER INCLUDING MEANS FOR TRANSVERSELY DISPLACING AND ADVANCING THE INK RIBBON IN THE CARTRIDGE

[75] Inventor: Kenneth Kress, Huntington, N.Y.

[73] Assignee: Primages Inc.

[21] Appl. No.: 609,784

[22] Filed: May 14, 1984

[51] Int. Cl.[4] ..... B41J 32/00

[52] U.S. Cl. ..... 400/208; 400/213; 400/234; 400/235.1

[58] Field of Search ..... 400/194, 195, 196, 196.1, 400/207, 208, 208.1, 213, 213.1, 216, 217, 224, 227.2, 234, 235.1, 248, 217.1

[56] References Cited

U.S. PATENT DOCUMENTS

| | | | |
|---|---|---|---|
| 2,734,615 | 2/1956 | Van Wallendael | 400/224 |
| 2,747,718 | 5/1956 | May | 400/248 X |
| 3,720,954 | 3/1973 | Czyryk | 400/248 X |
| 3,863,749 | 2/1975 | Perry et al. | 400/213 X |
| 3,904,015 | 9/1975 | Boyden et al. | 400/213 X |
| 4,111,293 | 9/1978 | Kockler et al. | 400/208 |
| 4,132,485 | 1/1979 | Hess | 400/208 |
| 4,209,261 | 6/1980 | Bell et al. | 400/196.1 |
| 4,252,450 | 2/1981 | Goodman et al. | 400/208 |
| 4,280,767 | 7/1981 | Heath | 400/213 X |
| 4,297,043 | 10/1981 | Dargatz | 400/248 X |
| 4,401,394 | 8/1983 | Hume et al. | 400/208 |
| 4,402,621 | 9/1983 | Abell, Jr. et al. | 400/248 X |
| 4,448,556 | 5/1984 | Trezise et al. | 400/196 X |
| 4,449,837 | 5/1984 | Craft | 400/234 X |

FOREIGN PATENT DOCUMENTS

| | | | |
|---|---|---|---|
| 0089979 | 7/1981 | Japan | 400/196.1 |
| 0201684 | 12/1982 | Japan | 400/208 |
| 0059488 | 4/1984 | Japan | 400/208 |

OTHER PUBLICATIONS

IBM Technical Disclosure Bulletin, "Ribbon Feeding Device", Reed, vol. 2, No. 5, Feb. 1960, p. 5.

IBM Technical Disclosure Bulletin, "Ribbon Oscillating Guide Mechanism", Kirksey et al, vol. 16, No. 5, Oct. 1973, pp. 2–3.

IBM Technical Disclosure Bulletin, "Ribbon Drag Wire", Lenney, vol. 18, No. 4, Sep. 1975, p. 1093.

IBM Technical Disclosure Bulletin, "Ribbon Cartridge", Okcuoglu, vol. 22, No. 9, Feb. 1980, p. 4120.

*Primary Examiner*—Ernest T. Wright, Jr.

*Attorney, Agent, or Firm*—Roberts, Spiecens & Cohen

[57] ABSTRACT

An ink ribbon cartridge for a printer comprising a storage reel for an ink ribbon, a take-up reel for the ink ribbon, drive wheels for longitudinally advancing the ink ribbon from the storage reel to the take-up reel for printing on the ribbon and a pulley which rides on a cam for transversely displacing the ribbon during its longitudinal advance to produce a saw-tooth path of travel of the ribbon and offset the area of the ribbon utilized in printing.

12 Claims, 6 Drawing Figures

INK RIBBON CARTRIDGE FOR A PRINTER INCLUDING MEANS FOR TRANSVERSELY DISPLACING AND ADVANCING THE INK RIBBON IN THE CARTRIDGE

FIELD OF THE INVENTION

The invention relates to an ink ribbon cartridge for a printer and, particularly, to apparatus and methods for advancing the ink ribbon in the cartridge.

BACKGROUND

Ink ribbon cartridges for printers are well known and rely on a substantially longitudinal advance of the ribbon in the course of a printing operation. Such longitudinal advance is uneconomical taking into account the unutilized area of the ribbon in the printing operation.

Accordingly, efforts have been made to maximize the area of the ribbon utilized in the printing operation. These include a feed of the ribbon such that the characters are over-struck thereon. Conventionally, the ribbon is shifted approximately 1/5 of the width of a conventional character to achieve a so called 4/5 over-strike. This is generally acceptable on the finished product for all characters except those in which there are a succession of horizontal lines such as for the letters E and F and for underlining. Under such circumstances, the horizontal stroke produced on the paper is formed at its left end on a part of the ribbon which is struck five times, whereas, at the right end, it is formed on a part of the ribbon struck once. As a consequence, the resulting stroke is uneven in appearance.

In order to avoid this, it is known to vertically displace or dither the ribbon so that the horizontal strokes will be displaced on the ribbon to avoid striking the same region of the ribbon.

This is conventionally achieved by means external of the cartridge and generally, by displacing the entire cartridge and the ribbon therewith. Such conventional construction is complex, costly and generally requires a power drive.

SUMMARY OF THE INVENTION

An object of the invention is to provide an ink ribbon cartridge for a printer and a method of drive of the ribbon by which the ribbon undergoes a dithering displacement without the use of means external of the cartridge.

A further object of the invention is to provide an ink ribbon cartridge in which the advance of the ribbon is effected along an undulating path.

In a particular embodiment of the invention, the undulating path is of saw-tooth shape.

In order to satisfy the above and further objects of the invention, the longitudinally advancing ribbon is subjected to a transverse displacement from within the cartridge.

According to a feature of the invention, the transverse displacement is effected by engaging the ribbon in the cartridge with a rotatable member such as a pulley which rides on a fixed cam member which produces transverse displacement of the pulley as it rotates under the action of the advance of the ribbon. As a consequence of the arrangement, the pulley rides up and down on the fixed cam member as it rotates to produce the transverse displacement of the ribbon and confer the undulating path of travel to the ribbon.

DETAILED DESCRIPTION

Figure 1:
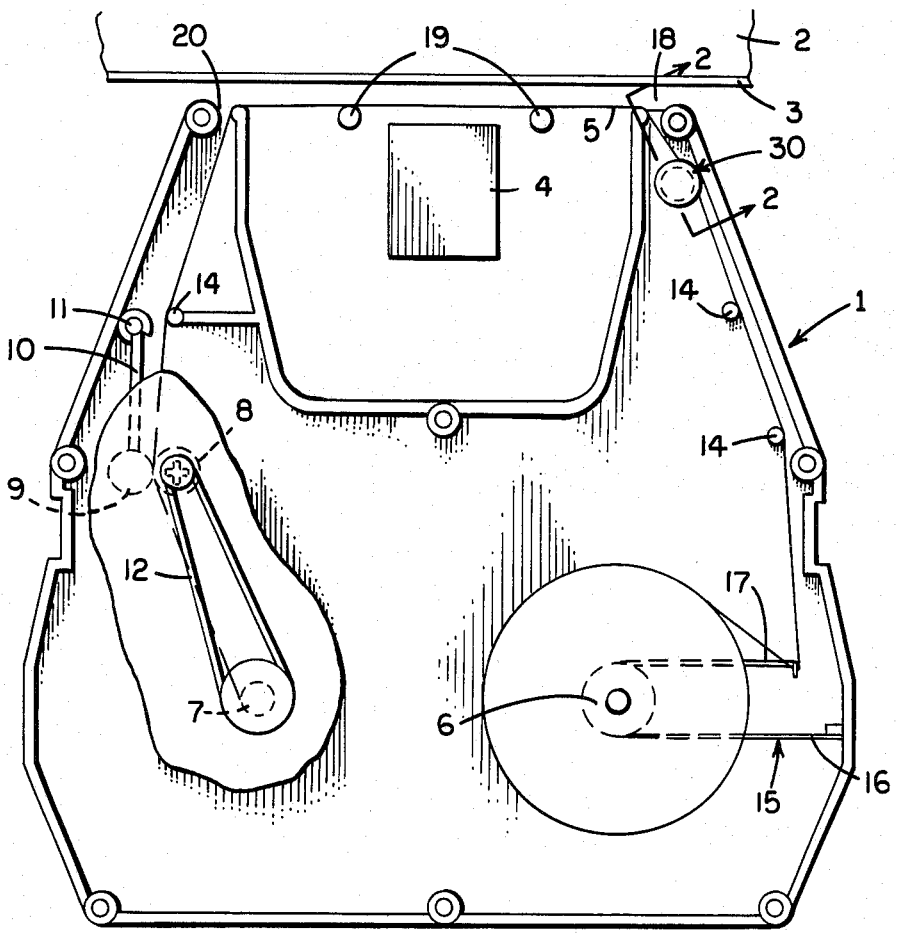
FIG. 1 is a top plan view of an ink ribbon cartridge with the top cover broken away and partially removed to show the interior details.

Referring to FIG. 1 therein is shown an ink ribbon cartridge 1, the basic construction of which is conventional in the art. The cartridge 1 is adapted for use with a printer (not shown) by being mounted on a carrier (not shown) so as to be transported past a platen 2 to effect printing on a sheet of paper 3 by a print head 4 which strikes an ink ribbon 5 carried by the cartridge 1.

In particular, the cartridge 1 includes a supply or storage reel 6 for the ribbon 5 and a take-up reel 7 on which the ribbon 5 is wound after it has completed a printing operation.

The ribbon 5 is driven by a drive wheel 8 which is rotatably mounted in the cartridge 1. A counter wheel 9 is supported by an arm 10 on a pivot 11 and is biassed by a spring (not shown) to be pressed against wheel 8. The wheels 8 and 9 are knurled in order to frictionally grip the ribbon 5 to pull the ribbon 5 from the supply reel 6 towards the take-up reel 7. A belt 12 is externally mounted on the cartridge 1 to connect the drive wheel 8 with the take-up reel 7 so that as the ribbon 5 is driven by the drive wheel 8, the take-up reel 7 will be rotated to take-up the advancing ribbon 5 and wind it on the take-up reel 7. The drive of the drive wheel 8 is effected from the carrier by the engagement of a drive member (not shown) on the carrier in a slot 13 at the underside of the wheel 8.

The cartridge 1 is provided with a number of guide pins 14 for guiding the ribbon 5 in its travel.

The supply reel 6 is provided with a spring 15 which acts to apply a tension to the ribbon 5 as it is wound off the supply reel 6. The spring 15 comprises an arm 16 which abuts against the cartridge 1 and a guide 17 which engages the ribbon 5 as it comes off the supply reel 6 to apply a tensile force to the ribbon 5. The ribbon 5 travels in its longitudinal path from the supply reel 6 through an exit slot 18 where it undergoes passage over pins 19 on the carrier which position the ribbon 5 in front of the print head 4 in suitable position for a printing operation. The ribbon 5 then travels back into the cartridge 1 through a slot 20 for engagement with the knurled wheels 8 and 9 and take-up by the reel 7.

Up to this point the construction of the cartridge 1 is entirely conventional.

The invention provides a means 30 positioned within the cartridge 1 to produce transverse or dithering displacement of the ribbon 5 in the course of its longitudinal advance to offset the area of the ribbon 5 utilized in printing.

Figure 2:
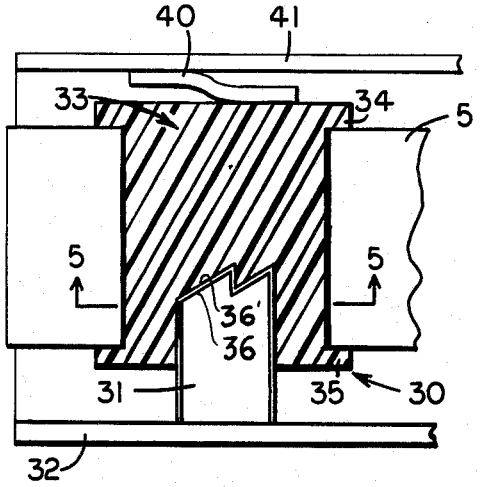
FIG. 2 is a view taken along lines 2—2 in FIG. 1 partly broken away and in section.

As seen in FIG. 2, the means 30 for transversely displacing the ribbon 5 comprises a fixed member 31 which is secured in upright manner to a bottom wall 32 of the cartridge 1 and a movable member 33 which is rotatable on the fixed member 31 and also axially displaceable thereon. The rotatable member 33 is in the form of a pulley which includes upper and lower flanges 34 and 35 between which the ribbon 5 is embraced. As the ribbon 5 is longitudinally advanced under the drive of the wheels 8 and 9 the ribbon 5 produces rotation of the pulley 33. If necessary, the surface of the pulley 33 can be treated to ensure such rotation by the ribbon 5 and also to ensure its rotation on the fixed member 31. This might take the form of surface treatment of the pulley 33 with high or low friction material as the case may be.

The upper end of the fixed member 31 is formed as a cam 36 and the pulley 33 is formed as a cam 36' of mirror image to cam 36. The cam 36' rides on the cam 36 to impart the transverse movement, up and down, of the pulley 33 on the fixed member 31.

Figure 3:
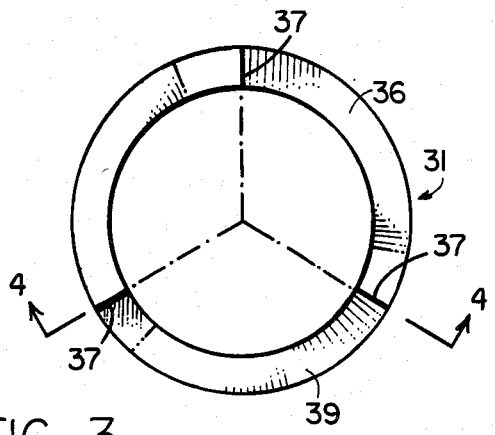
FIG. 3 is a top plan view of a fixed cam member of a portion of the cartridge.
Figure 4:
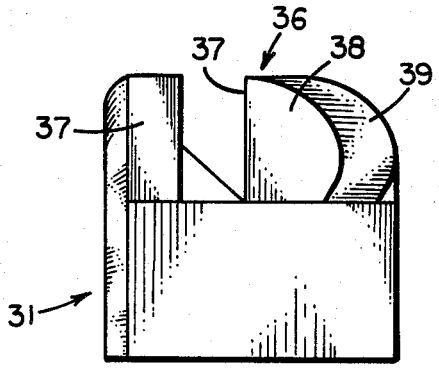
FIG. 4 is a sectional view taken on line 4—4 in FIG. 3.
Figure 5:
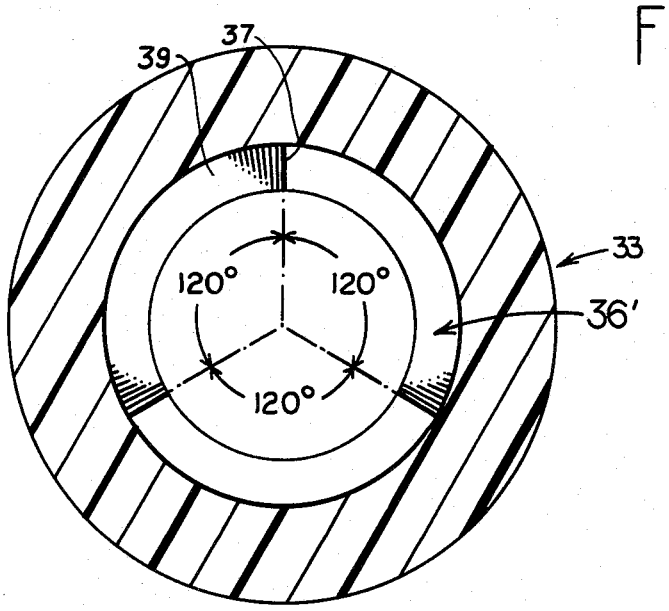
FIG. 5 is a sectional view taken on line 5—5 in FIG. 2.

The cams 36 and 36' are each provided with a plurality of peaks 37(three as shown in FIGS. 3 and 4). The peaks 37 are arranged at equal spacing around the periphery of fixed member 31 and, hence, are spaced at 120° from one another. Each peak 37 ends a cam segment 38 which cooperates successively with the corresponding cam segments 38 of the other cam as the pulley 33 rotates on member 31. Each cam segment 38 has an upper surface 39 on which the cam segments 38 of the other cam ride and the surface 39 extends from the peak 37 in uniformly diminishing height towards the following peak 37 of the next cam segment 38.

Figure 6:
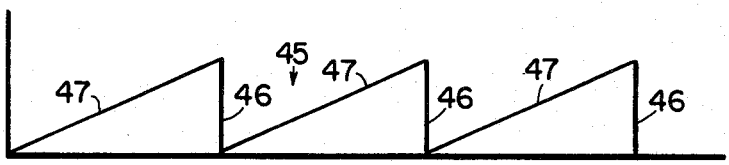
FIG. 6 is a graphical illustration of the path of travel of the ribbon in the cartridge.

The path of travel 45 of the ribbon 5 is shown in FIG. 6 and therein it can be seen that a transverse displacement component 46 is added to the longitudinal component of advance so that the path of travel 45 an undulating path. Because the cam surface 39 uniformly increases from one peak 37 to the next, the undulating path 45 will be saw-tooth in shape as illustrated in FIG. 6 wherein the transverse displacement component 46 is vertical and follows an ascending displacement component 47. However, the undulating path 45 could be composed of curved ascending portions by suitable alteration of the shape of cam surfaces 39.

The tight embrace of the ribbon 5 between the flanges 34 and 35 of the pulley 33 will generally be sufficient to move the pulley 33 up and down on the fixed member 31 due to the tension in the ribbon 5. However, to supplement the descent of the pulley 33 on the member 31, a light spring 40 can be secured to the upper wall 41 of the cartridge 1 to apply a downwards bias force to the pulley 33.

As is evident from the above, the provision of the simple means 30 in the cartridge 1 serves to move the ribbon 5 reciprocally up and down in the course of its longitudinal advance which serves to offset the area of the ribbon 5 utilized in the printing operation.

While numerous modifications and variations of the invention will become evident to those skilled in the art, these are deemed to be within the scope and spirit of the invention if defined in the attached claims.

Thus, for example, the means 30 which is shown within the cartridge 1 could also be mounted on the outside of the cartridge 1.

What is claimed is:

1. An ink ribbon cartridge comprising a storage reel for an ink ribbon, a take-up reel for the ink ribbon, means for longitudinally advancing the ink ribbon from the storage reel to the take-up reel, and means supported by the cartridge for transversely displacing the ribbon during its longitudinal advance including a fixed member, a pulley with an axial opening rotatably receiving the fixed member, said ribbon passing on said pulley to rotate the pulley during longitudinal advance of the ribbon, said fixed member having an end cam surface, the pulley having a corresponding cam surface facing and engaging the cam surface on the fixed member, said cam surfaces respectively including a plurality of peaks and an inclined surface between successive peaks to produce a saw-tooth path of travel of the ribbon as the ribbon advances on said pulley.

2. An ink ribbon cartridge as claimed in claim 1 wherein said peaks have vertical edges.

3. An ink ribbon cartridge as claimed in claim 2 wherein said pulley includes end flanges which embrace the ribbon.

4. An ink ribbon cartridge as claimed in claim 2 comprising means biassing the pulley towards an initial position from which the pulley is periodically displaced by said cam surfaces.

5. An ink ribbon cartridge as claimed in claim 2 wherein said fixed member and pulley are located within the cartridge upstream of a printing station.

6. An ink ribbon cartridge as claimed in claim 2 comprising upper and lower walls, said fixed member and pulley being mounted within said cartridge between said walls.

7. An ink ribbon cartridge as claimed in claim 6 wherein said fixed member is fixed to one of said walls.

8. An ink ribbon cartridge as claimed in claim 1 wherein said fixed member extends in upright manner in said cartridge, said pulley resting on said upright member through the intermediary of said cam surfaces.

9. A method of advancing an ink ribbon in a cartridge comprising advancing the ink ribbon along a longitudinal path of travel, engaging the ribbon within the cartridge by a rotatable member to rotate said rotatable member with the advancing ribbon and supporting the rotatable member by a fixed member which axially interfits within the rotatable member and which provides a support surface of an engaging surface of said rotatable member, camming said surfaces for producing transverse displacement of the rotatable member in response to its rotation to produce transverse displacement of the ribbon concurrently with its longitudinal advance and a saw-tooth path of travel for said ribbon.

10. A method as claimed in claim 9 comprising resiliently pressing the rotatable member against the fixed member.

11. A method as claimed in claim 10 comprising confining said rotatable and fixed members between upper and lower walls of the cartridge.

12. A method as claimed in claim 9 wherein the saw-tooth path is formed by vertical displacement components joined by inclined displacement components.

* * * * *